US005884876A

United States Patent [19]

Axford

[11] Patent Number: 5,884,876

[45] Date of Patent: Mar. 23, 1999

[54] ADJUSTABLE GUTTER BRACKET ASSEMBLY

[75] Inventor: Paul Phillip John Axford, New South Wales, Australia

[73] Assignee: Keytown Pty Ltd, New South Wales, Australia

[21] Appl. No.: 849,867

[22] PCT Filed: Dec. 19, 1995

[86] PCT No.: PCT/AU95/00860

§ 371 Date: Jun. 17, 1997

§ 102(e) Date: Jun. 17, 1997

[87] PCT Pub. No.: WO96/19624

PCT Pub. Date: Jun. 27, 1996

[51] Int. Cl.[6] ..... E04D 13/072

[52] U.S. Cl. ..... 248/48.2; 248/48.1

[58] Field of Search ..... 248/48.2, 48.1, 248/245.11, 296.1, 297.21, 297.31, 292.12; 52/11

[56] References Cited

U.S. PATENT DOCUMENTS

| | | | |
|---|---|---|---|
| 1,017,174 | 2/1912 | Sander et al. | 248/48.1 |
| 1,020,951 | 3/1912 | Patchin | 248/48.2 |
| 1,755,453 | 4/1930 | Mullen | 248/48.1 |
| 2,187,869 | 1/1940 | Tobin | 248/48.1 |
| 4,561,616 | 12/1985 | Robinson | 248/48.2 |

FOREIGN PATENT DOCUMENTS

| | | | |
|---|---|---|---|
| 759039 | 10/1956 | United Kingdom | 248/48.1 |
| 9209021 | 5/1992 | WIPO | 248/48.2 |

*Primary Examiner*—Leslie A. Braun
*Assistant Examiner*—Gwendolyn Baxter
*Attorney, Agent, or Firm*—Merchant, Gould, Smith, Edell, Welter & Schmidt

[57] ABSTRACT

A bracket assembly, particularly for supporting a roof gutter, is disclosed. The assembly includes a mounting member attachable to a fascia and a support member releasably attachable to the mounting member. Attachment is by relation of the support member relative to the mounting member such that lugs on the support member engage an elongate aperture in the mounting member. The bracket assembly may incorporate a cover attachment member to facilitate concealed covering.

19 Claims, 2 Drawing Sheets

ADJUSTABLE GUTTER BRACKET ASSEMBLY

FIELD OF THE INVENTION

THIS INVENTION relates to a bracket assembly and in particular a bracket assembly for supporting a roof gutter.

BACKGROUND OF THE INVENTION

Brackets for supporting roof gutters usually are generally U shaped having an upright section for attachment to a fascia and a gutter support arm for engagement with an adjacent peripheral edge of the roof gutter.

When such brackets are mounted along a fascia, the supporting arm of each bracket must be spaced relative to the supporting arms of other gutter brackets to provide sufficient gutter support. Each arm must also be positioned such that gutters supported therefrom are supported in an inclined longitudinal orientation to allow for water drainage. This arrangement of the gutter and associated supporting brackets may be unsightly and visually displeasing, especially on long gutter runs where the drainage angle is noticeable.

To position a number of brackets along a fascia or the like such that they provide support and a drainage inclination is time consuming. Generally this is achieved by fixing a gutter bracket at each end of a gutter run and stretching a string line therebetween.

Subsequent intermediate brackets are then fixed to a support surface using the string line as a guide.

OBJECT OF THE INVENTION

It is an aim of the invention to overcome or alleviate some of the problems associated with the abovementioned prior art.

DISCLOSURE OF THE INVENTION

According to one aspect of the invention there is provided an adjustable gutter bracket assembly including;

a mounting member;

a support arm releasably attachable to said mounting member; and a cover attachment member releasably attached to said support arm;

said mounting member and said support arm having complementary engagement means associated therewith to provide releasable attachment of said support arm to said mounting member in a plurality of height adjustment positions; and said cover attachment member and said support arm having further complementary engagement means associated therewith to provide releasable attachment of said cover attachment means to said support arm.

Preferably, said mounting member and said support arm each have corresponding surfaces or walls which are in substantial abutment when attached.

Suitably, said relative rotation is about an axis normal to the corresponding surface of said mounting member.

One of said complementary engagement means may be an elongate aperture which may have height adjustment corrugations or serrations comprising alternating notches and projections. Alternatively there may be provided spaced notches along each longitudinal edge of the elongate aperture.

The other one of said complementary engagement means may suitably comprise a pair of spaced lugs wherein preferably each lug includes an inner web and outwardly projecting tab which may be punched out of the support arm or the mounting member. Suitably, each tab has free ends which are of opposite orientation.

The elongate aperture may be located in one of the mounting member or the support arm with the lugs being provided in the other of said mounting member or support arm. Preferably, however the elongate aperture is provided in the mounting member and the lugs are located in the support arm.

Preferably, the mounting member has spacing means associated therewith to allow at least part of the mounting member to be spaced from a roof fascia when said mounting member is attached to said fascia. To this end the mounting member may have one or more and preferably a pair of peripheral longitudinal flanges and a spaced intermediate part incorporating said elongate aperture.

Preferably, each peripheral longitudinal flange has mounting apertures therein.

Most preferably, the mounting member is a mounting plate and the support arm includes an inner end section attachable to the mounting plate. The support arm may also include an intermediate section and an outer end section.

The further complementary engagement means may be of a similar nature to that as described above, wherein one of said further complementary engagement means is associated with the cover attachment member and the other of said further complementary engagement means is associated with the outer end section of the support arm.

Suitably, the cover attachment member has spacer means for spacing said one of the further complementary engagement means from a cover or fascia which may be attached to said cover attachment member. The cover attachment member may be an attachment plate.

BRIEF DESCRIPTION OF THE DRAWINGS

In order that the invention may be readily understood and put into practical effect reference will now be made to a preferred embodiment in which.

DETAILED DESCRIPTION

Figure 1:
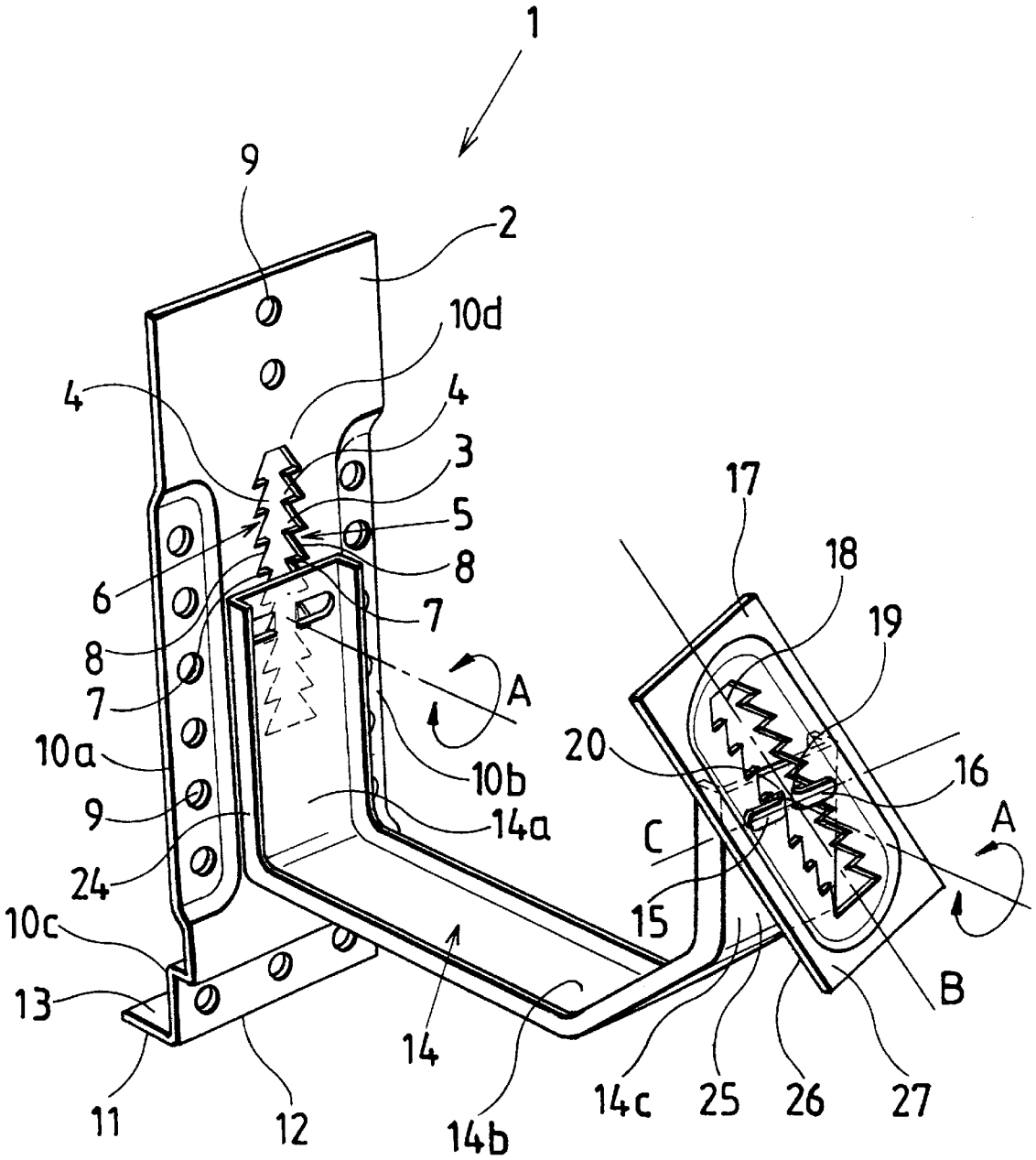
FIG. 1 is a perspective view of the bracket assembly.
Figure 2:
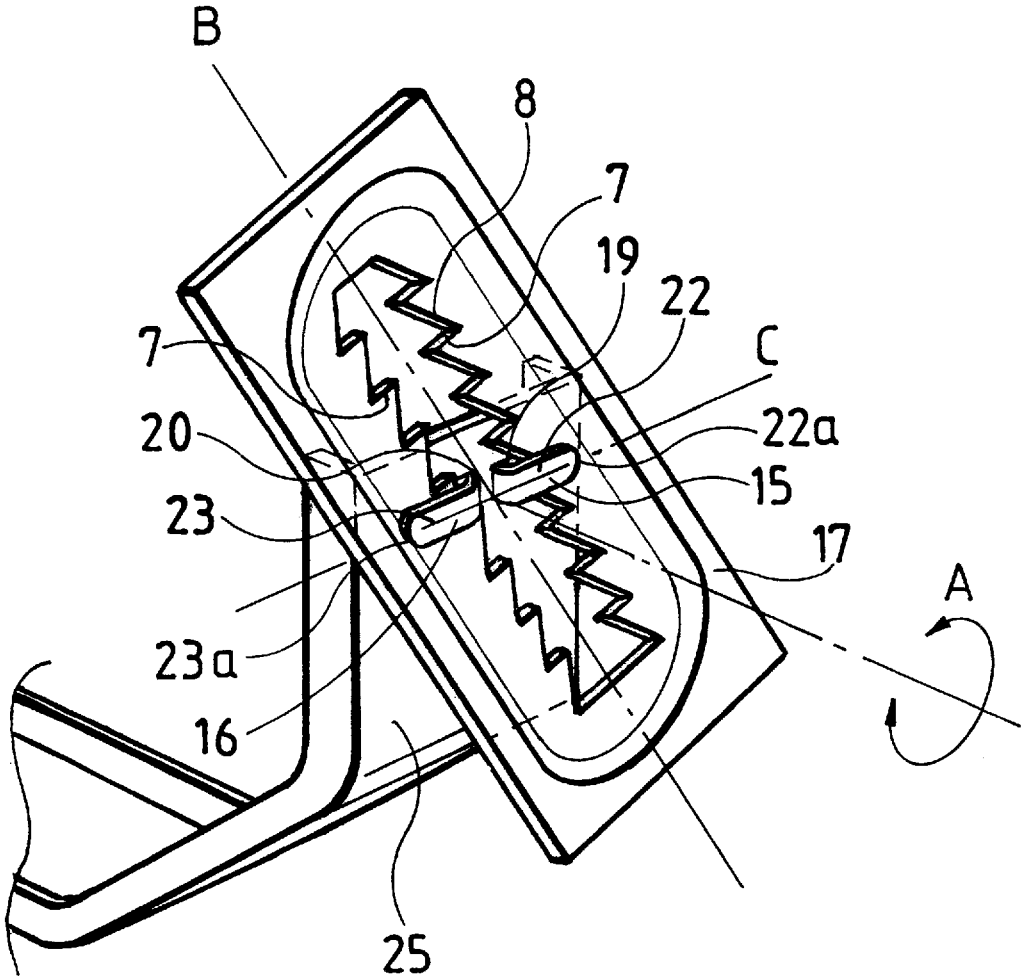
FIG. 2 is a magnified view of the complementary engagement means of FIG. 1.

Referring to FIGS. 1 and 2, the bracket assembly 1 includes a mounting member in the form of mounting plate 2 for mounting to an upright surface such as a fascia (not shown).

An engagement means in the form of an aperture 3 is formed in mounting plate 2. Aperture 3 has a plurality of opposed triangular shaped notches 4 on opposed longitudinal edges 5 and 6.

Triangular shaped notches 4 comprise opposed lateral ledges 7 and inclined regions 8 between adjacent lateral ledges 7. Notches 4 provide height adjustment positions in which the transverse distance T between each pair of opposed lateral ledges 7 are equal.

Mounting apertures 9 are located in peripheral longitudinal flanges 10*a* and 10*b* and are spaced from intermediate section 10*d* in which aperture 3 is located, thereby providing a spacing means for spacing aperture 3 from the fascia (not shown). A transverse flange 10*c* is also provided adjacent end 12.

An end flange 11 on mounting plate 2 provides an abutment surface 13 for abutting an underside of the facia or other similar upright surface.

Support arm 14 includes inner end section 14*a*, intermediate section 14*b* and outer end section 14*c*. Section 14*a* has an upright wall 24 which is in substantial abutment with adjacent mounting plate 2. Inner end section 14*a* also has a complementary engagement means in the form of two lugs 15 and 16 which are identical to lugs 15 and 16 at outer end section 14*c*. Further, an attachment plate 17 having an elongate aperture 18, which is identical to aperture 3, is releasably attached to outer end section 14*c*.

Lugs 15 and 16 each have a respective web 19 and 20 and an outer tab 22 and 23 punched out of outer end section 14*c*. Outer tabs 22 and 23 are parallel to outer end section 14*c* and they each have a free end 22*a* and 23*a* which are of opposite orientation.

Mounting plate 2 and inner end section 14*a* each have an abutment surface (hidden by support arm 14), such that when mounting plate 2 and support arm 14 are releasably attached, the respective abutment surfaces are in substantial abutment as indicated at 24.

Similarly, outer end section 14*c* and plate 17 have respective abutment surfaces 25 and 26 which are in substantially abutment when outer end section 14*c* and plate 17 are engaged. Spacing means on surface 27 provides a means of spacing aperture 18 from a cover or fascia which may be attached to plate 17 (by drilling and bolting or otherwise).

Attachment and height adjustment of support arm 14 to mounting plate 2 is identical to the attachment of plate 17 to outer end section 14*c*.

To avoid repetition only the attachment of plate 17 to end 14*c* will be described in detail.

Lugs 15 and 16 are aligned such that their collinear axis C is aligned with longitudinal axis B of aperture 18. Lugs 15 and 16 are then inserted into aperture 18. Relative rotation of plate 17 with respect to outer end section 14*c* about axis A causes releasable attachment thereof, axis A being normal to abutment surface 25 (similarly when referring to plate member 2, axis A is normal to upright wall 24). When axis B and C are normal to each other, plate 17 is attached to end 16. The attachment is such that webs 19 and 20 engage opposed notches 4 and are each disposed between a respective ledge 7 and adjacent inclined region 8. Height adjustment is achieved by relative rotation about axis A until axes B and C are aligned in relation to a selected opposed pair of notches 4.

In use a plurality of mounting plates 2 are attached to a fascia (not shown) by screws passing through mounting apertures 9. Each associated abutment surface 13 abuts an underside of the fascia end allows for identical upright positioning of each mounting plate 2.

Abutment surfaces 10 provide a spacing such that the fascia or upright surface does not interfere with the engagement of lugs 15 and 16 of support arm 14 when engaging aperture 4.

Each support arm 14 is releasably attached to a mounted mounting plate 2 by relative rotation therebetween. Where required the height adjustment of each support arm 14 may be adjusted (as described above).

Guttering is then supported from the support arms and further height adjustment of support arms 14 may be effected if required.

If desired plates 17 are then attached to outer end section 16 and their height is adjusted accordingly after which a cover or fascia is attached thereto to hide the guttering. Surface 27 spaces the cover or fascia from lugs 15 and 16 to allow a flush fitting.

Although the invention has been described with reference to a preferred embodiment it is to be understood that the invention is not limited to the specific embodiment as described herein. Other embodiments and variations to the preferred embodiments may be evident to those skilled in the art and may be made without departing from the spirit and scope of the invention.

It is claimed:

1. An adjustable gutter bracket assembly comprising:

a mounting member;

a support arm releasably attachable to said mounting member; and a cover attachment member releasably attached to said support arm;

said mounting member and said support arm having complementary engagement means associated therewith to provide releasable attachment of said support arm to said mounting member in a plurality of height adjustment positions; and said cover attachment member and said support arm having further complementary engagement means associated therewith to provide releasable attachment of said cover attachment means to said support arm, wherein said further complementary engagement means provides releasable attachment in a plurality of height adjustment positions.

2. The bracket assembly of claim 1 whereby said support arm is attachable to said mounting member by relative rotation therebetween.

3. The bracket assembly of claim 2 wherein each said relative rotation is about an axis substantially normal to the corresponding surface of said mounting member.

4. The bracket assembly of claim 1 whereby said cover attachment member is attachable to said support arm by relative rotation therebetween.

5. The bracket assembly of claim 4 wherein said relative rotation is about an axis substantially normal to the corresponding surface of said support arm.

6. The bracket assembly of claim 1 wherein said mounting member and said support arm each have corresponding surfaces in substantial abutment when attached.

7. The bracket assembly of claim 1 wherein said cover attachment member and said support arm each have corresponding surfaces in substantial abutment when attached.

8. The bracket assembly of claim 1 wherein one of said complementary engagement means is an elongate aperture incorporating height adjustment corrugations or serrations comprising alternating notches and projections.

9. The bracket assembly of claim 1 wherein one of said complementary engagement means is an elongate surface incorporating spaced notches along each longitudinal edge.

10. The bracket assembly of claim 1 wherein the support arm comprises an inner end section, an outer end section and an intermediate section, the inner end section being attachable to the mounting member and the outer end section being attachable to the cover attachment member.

11. The bracket assembly of claim 10 wherein each tab has free ends which are of opposite orientation.

12. The bracket assembly of claim 1 wherein one of said complementary engagement means is an elongate aperture incorporating height adjustment corrugations or serrations comprising alternating notches and projections and wherein the other one of said complementary engagement means comprises a pair of spaced lugs wherein each lug includes an inner web and outwardly projecting tab.

13. The bracket assembly of claim 12 wherein the elongate apertures of the complementary engagement means and the further complementary engagement means are located in the support arm and the lugs are formed in the mounting member and cover attachment member respectively.

14. The bracket assembly of claim 12 wherein the elongate apertures of the complementary engagement means and the further complementary engagement means are located in the mounting member and cover attachment member respectively and the lugs are formed in the support arm.

15. The bracket assembly of claim 1 wherein the mounting member has spacing means associated therewith to allow at least part of the mounting member to be spaced from a roof fascia when said mounting member is attached to said fascia.

16. The bracket assembly of claim 15 wherein the spacing means comprise one or more peripheral longitudinal flanges and a spaced intermediate part incorporating said elongate aperture.

17. The bracket assembly of claim 16 wherein each peripheral longitudinal flange has mounting apertures therein.

18. The bracket assembly of claim 1 wherein the cover attachment member has spacer means for spacing said one of the further complementary engagement means from a cover or fascia which may be attached to said cover attachment member.

19. The bracket assembly of claim 1 wherein the mounting member comprises a mounting plate and the cover attachment member comprises an attachment plate.

* * * * *